United States Patent [19]

Shaver

[11] Patent Number: 4,535,336

[45] Date of Patent: Aug. 13, 1985

[54] ANTENNA LUGGAGE RACK

[76] Inventor: Larry D. Shaver, 3312 Remington Dr., Plano, Tex. 75023

[21] Appl. No.: 545,402

[22] Filed: Oct. 25, 1983

[51] Int. Cl.[3] ..... H01Q 1/32

[52] U.S. Cl. ..... 343/713

[58] Field of Search ..... 343/711, 712, 713, 715, 343/846

[56] References Cited

U.S. PATENT DOCUMENTS

| | | | |
|---|---|---|---|
| 3,154,786 | 10/1964 | Clanton | 343/713 |
| 3,696,431 | 10/1972 | Holland | 343/713 |
| 3,864,686 | 2/1975 | Owen | 343/713 |

FOREIGN PATENT DOCUMENTS

| | | | |
|---|---|---|---|
| 2926758 | 1/1981 | Fed. Rep. of Germany | 343/713 |
| 1559470 | 1/1980 | United Kingdom | 343/713 |

OTHER PUBLICATIONS

Christianson Industries, Inc. Brochure Entitled "Wood Grained Luggage Rack" (Photocopy) Sketch.

*Primary Examiner*—Eli Lieberman

*Attorney, Agent, or Firm*—Flynn, Thiel, Boutell & Tanis

[57] ABSTRACT

An antenna luggage rack for a vehicle having a substantially rectangular, rigid ringlike frame which has stanchions secured to the corners thereof for fixedly positioning and supporting the frame in upwardly spaced relationship from the roof of a vehicle. The frame defines therein an upwardly opening luggage-receiving pocket. The frame is defined by opposed parallel side rails joined together by front and rear cross rails which extend perpendicularly therebetween. Brackets are secured to opposite ends of the cross rails for securing the latter to the side rails. The brackets at one diametrically opposite pair of corners of the frame are of an insulative material, whereas the brackets at the other pair of diametrically opposite corners of the frame are of a conductive material. One side rail and connected cross rail hence define one elongated conductive path, and the other side rail and connected cross rail define another elongated path of substantially the same length. A conventional television transformer is connected across one of the corners of the frame having the nonconductive bracket associated therewith.

4 Claims, 5 Drawing Figures

ANTENNA LUGGAGE RACK

FIELD OF THE INVENTION

This invention relates to an improved antenna luggage rack for a vehicle.

BACKGROUND OF THE INVENTION

Many recreation vehicles, such as the so-called "van conversions", require extra storage space for luggage and the like, and hence are provided with roof racks for luggage storage. Conventional automotive-type luggage racks have been used for this purpose, which racks employ a rigid ringlike rectangular frame for surrounding a luggage-receiving pocket. Racks of this type are desirable for luggage storage due to their strength and rigidity, and their surrounding confinement of the luggage or other articles stored therein. However, many recreation vehicles are also equipped with television and hence require an external antenna. Many such vehicles are provided with a wholly separate antenna for television reception, although the use of such antenna is undesirable since not only is a wholly separate structure required, but the antenna itself is unsightly and is readily damaged.

In an attempt to avoid use of a separate television antenna, there is known a so-called roof rack which also functions as a television antenna. This known rack, however, does not define an enclosed luggage-receiving pocket, but rather defines only side and rear rails which can be utilized for strapping luggage thereto. More specifically, this known rack employs a pair of substantially L-shaped rails having long legs which are positioned so as to extend in parallel relationship along the opposite sides of the roof of the vehicle, and having short legs which are positioned adjacent the rear of the vehicle and extend inwardly toward and terminate in slightly spaced relationship from one another. The free ends of the short legs are slightly spaced to avoid direct contact, and a conventional television transformer is connected thereacross to permit the television antenna cable to be joined thereto. With this arrangement, however, the front of the region between the rails is wholly open. Utilization of this rack is hence difficult due to the openness of the region defined between the rails, and hence the lack of security in terms of positively enclosing and restraining the luggage or other articles which are attempted to be stored and transported on the roof of the vehicle. Also, this known rack does not possess desirable strength and rigidity.

Accordingly, it is an object of this invention to provide an antenna roof rack for a vehicle, which antenna roof rack overcomes the above-mentioned disadvantages.

More specifically, this invention relates to an improved antenna roof rack which utilizes a conventional automotive-type rack wherein there is provided a rigid rectangular ringlike frame disposed so as to define and enclose a luggage-receiving pocket. This ringlike frame has a TV transformer attached thereto so that the side rails and cross rails of the frame effectively define two antenna legs or arms which are both relatively long and of substantially the same length, but are effectively insulated from one another to prevent interference in the functioning of the arms as receivers for television signals.

The antenna luggage rack of this invention includes a substantially rigid, rectangular, ringlike frame defined by right and left side rails disposed in substantially parallel relationship, and rigidly joined together by front and rear cross rails which perpendicularly interconnect the side rails so as to define and surround a luggage-receiving pocket. This rectangular frame is provided with suitable support posts, particularly stanchions, which are fixedly secured adjacent each corner of the frame for securing the frame in parallel but upwardly spaced relationship from the roof of a vehicle. Insulators are positioned for cooperation between the stanchions and the vehicle roof so as to prevent interference with the frame in its functioning as a TV antenna. Each cross rail has a pair of brackets secured thereto, which brackets are slidably but fixedly secured within elongated slots formed in the side rails. One of the brackets associated with each cross rail is of an insulative material, such as a plastics material, whereas the other bracket is electrically conductive, as by being of metal or of a plastics material having a metal plating therearound. The cross rails when mounted on the side rails are positioned such that the two insulative brackets are disposed at one pair of diametrically opposite corners of the frame, and the pair of conductive brackets are disposed at the opposite pair of diametrically opposite corners of the frame. A television transformer is disposed adjacent one of the frame corners, normally a rear corner, having the insulative bracket associated therewith. The television transformer has a pair of antenna leads projecting therefrom, one of which is secured to the respective side rail in close proximity to the insulative bracket, and the other being fixed to the respective cross rail in close proximity to the same insulative bracket. In this fashion, the rear cross rail and one of the side rails define one arm of the television antenna, and the other side rail and the front cross rail define the other arm of the antenna, these two arms each being rather long and of substantially equal length. These arms are in nonconductive relationship with respect to one another so as to permit effective reception of television signals. At the same time, the rack has a rigid rectangular frame which provides desirable strength and rigidity, and also provides an enclosed luggage receiving pocket to permit desirable confinement and securement of luggage within the rack.

Other objects and purposes of the invention will be apparent to persons familiar with structures of this general type upon reading the following specification and inspecting the accompanying drawings.

DETAILED DESCRIPTION

Figure 1:
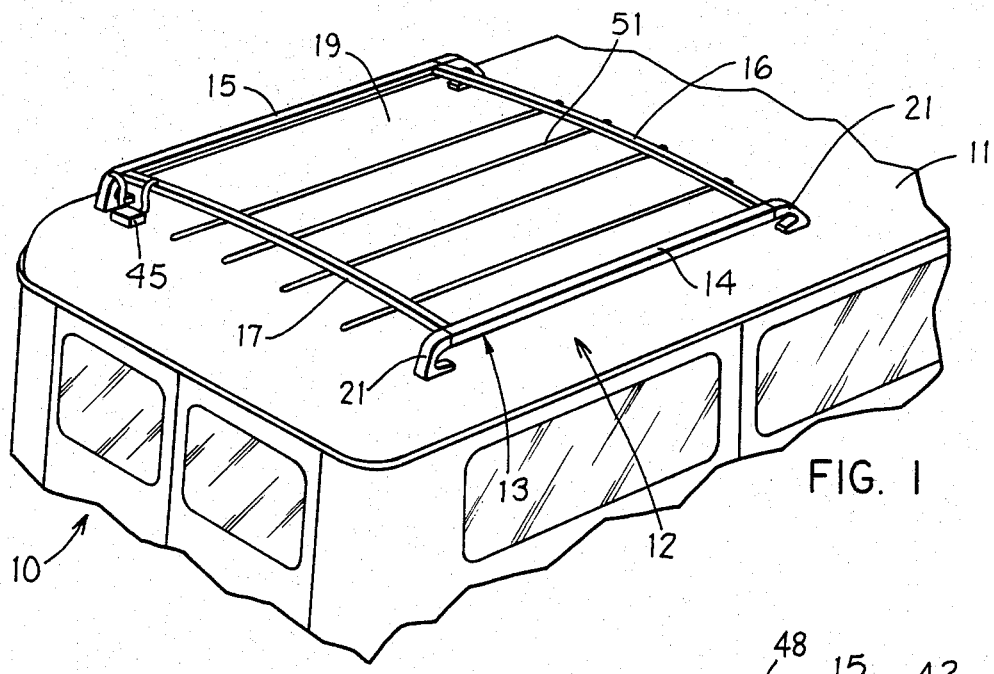
FIG. 1 is a fragmentary perspective view illustrating a vehicle, such as a van, having an antenna luggage rack according to the present invention mounted on the roof thereof.

Referring to FIG. 1, there is illustrated a vehicle 10, such as a van, having secured to its roof 11 an antenna luggage rack 12 according to this invention. This rack 12 has a substantially rigid, ringlike, rectangular frame 13 which includes substantially parallel right and left side rails 14 and 15, respectively. These side rails extend along and are positioned closely adjacent the sides of the vehicle roof, and are rigidly joined together by front and rear cross rails 16 and 17, respectively, which extend in substantially perpendicular relationship to the side rails. The frame 13, as defined by the side and cross rails, defines therein a rather large, upwardly opening luggage-receiving pocket 19.

The frame 14 is secured to, and maintained in spaced relationship upwardly from, the vehicle roof 12 by means of stanchions 21 which are fixed to the corners of the frame and project downwardly therefrom for fixed attachment to the vehicle roof.

Figure 5:
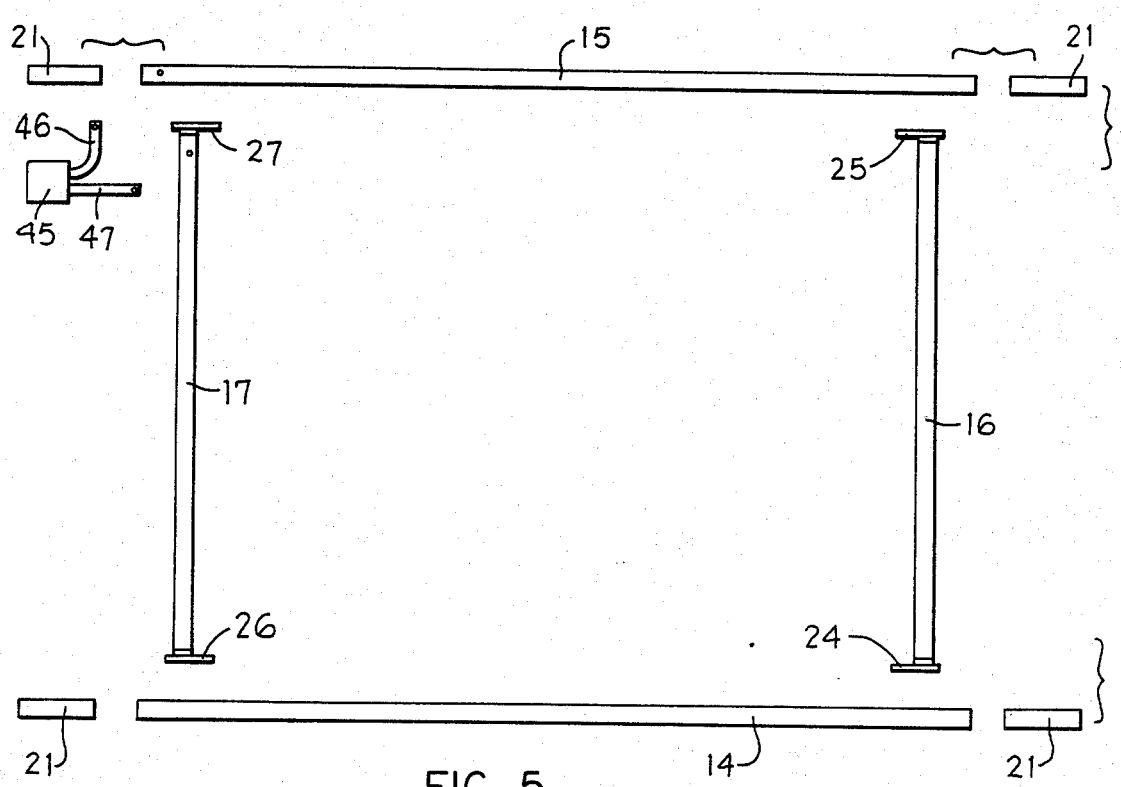
FIG. 5 is an exploded plan view showing the various components which make up the antenna luggage rack.

Each of the side rails 14 and 15 is formed by an elongated tubular element which, in the preferred embodiment, is substantially rectangular in cross section. The inner sidewall 22 of each side frame element preferably has a slot 23 which extends longitudinally throughout the length of the element and provides communication with the hollow interior thereof. These guide slots 23 are provided so as to slidably accommodate brackets which are secured to the ends of the cross rails. For example, as illustrated by FIG. 5, the front cross rail 16 has brackets 24 and 25 at opposite ends which are slidably accommodated within the side rails 14 and 15, respectively, and the rear cross rail has brackets 26 and 27 which are slidably accommodated in the side rails 14 and 15, respectively.

Figure 2:
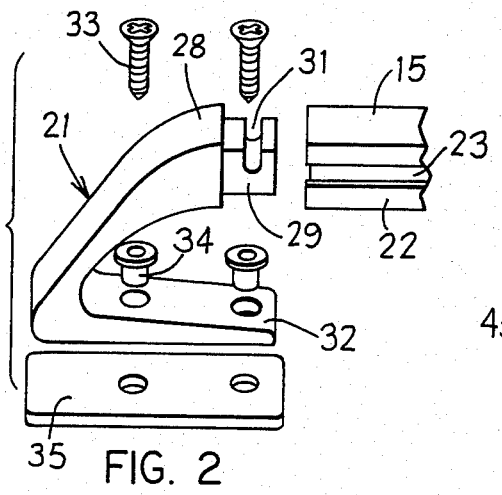
FIG. 2 is an enlarged, fragmentary perspective view illustrating the stanchion structure and its connection to the adjacent end of a side rail.
Figure 3:
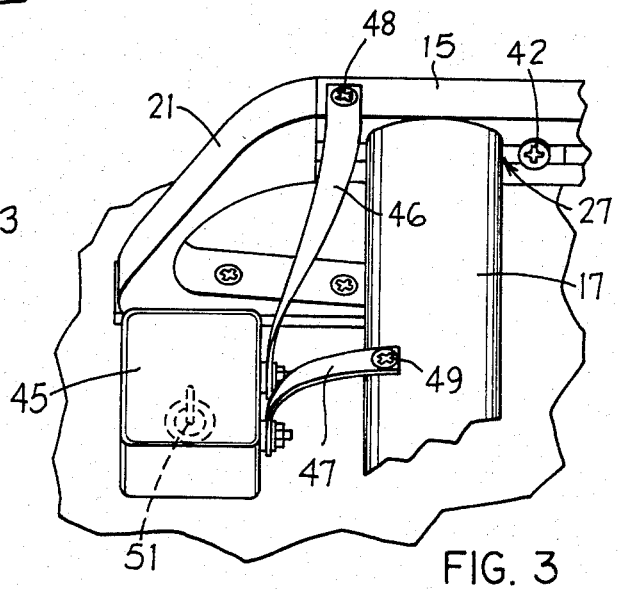
FIG. 3 is a fragmentary perspective view illustrating the connection of the television transformer to a corner of the rack frame.

As illustrated by FIG. 2, the stanchion 21 in the preferred embodiment is of a substantially U- or V-shaped configuration and includes an upper leg 28 which terminates in a horizontally extending projection 29 which projects into the adjacent end of the respective side rail. A locking screw (not shown) is then positioned through the top wall of the side rail so as to project into the notch 31 to fixedly secure the stanchion to the adjacent end of the side rail. The stanchion also has a lower leg 32 which directly overlies the vehicle roof 12 to provide a substantial area of supportive engagement therebetween. A pair of conventional sheet metal screws 33 extend downwardly through this lower leg 32 and through the vehicle roof to create a secure attachment therebetween. Conventional plastic bushings 34 are disposed in surrounding relationship to the screws 33, and a similar plastic or rubber pad 35 is positioned between the vehicle roof and the underside of the leg 32. The bushings 34 and pad 35 are nonconductive members which thus function both as insulators to prevent interference with the functioning of the rack as a TV antenna, and also prevent galvanic corrosion at the interface between the metallic components.

Figure 4:
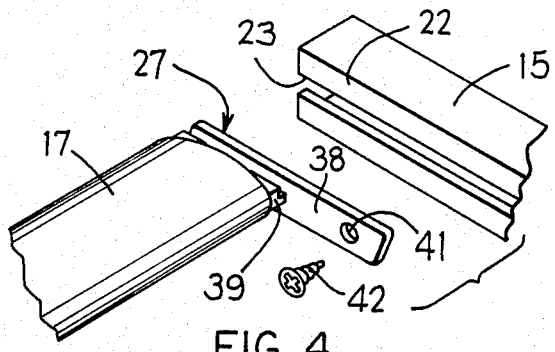
FIG. 4 is a fragmentary, exploded view illustrating the bracket which connects between the cross rail and the side rail.

Considering now the brackets 24–27, each of these brackets is of substantially the same configuration, and reference will be made to the bracket 27 illustrated by FIG. 4. This bracket includes a horizontally elongated slide plate 38 which is sized so as to snugly fit within but be slidably movable along the hollow interior of the tubular side rail 15. This slide plate 38, adjacent one end thereof, has a sidewardly projecting mounting part 39 which projects into and is fixedly secured within the adjacent hollow end of the respective cross rail, such as the rear cross rail 17. The other end of slide plate 38 has a suitable opening 41 therethrough, which opening accommodates a conventional locking screw 42 which is positioned in the opening and securely tightened for engagement with the respective side rail to fixedly lock the bracket relative to the side rail after selective positioning thereof.

All of the brackets 24–27 structurally and functionally resemble the bracket 27 described above. However, as illustrated by FIG. 5, the brackets 26 and 27 associated with the rear cross rail 17 are oriented such that their slide plates 38 project forwardly, whereas the other brackets 24 and 25 as associated with the front cross rail 16 are oriented such that their slide plates 38 project rearwardly.

The structure of the rack 12, as hereinabove described, is already in public use solely as a luggage rack. In this utilization, however, all of the brackets which are utilized for joining the cross rails to the side rails, which rails are all normally of aluminum, are constructed of plastics material.

According to the present invention, the above-described luggage rack additionally incorporates structure which permits it to function as a dipole antenna for television reception.

To permit accomplishment of this function, one of the diametrically opposite pair of brackets, specifically the brackets 24 and 27, are constructed of an insulating material, such as a plastics material, to form a rigid but insulative connection between the metal side and cross rails at the point of connection created by the brackets 24 and 27. The remaining diametrically opposed pair of brackets, namely the brackets 25 and 26, are constructed so as to provide a conductive path at the juncture between the metallic side and cross rails. For this purpose, the brackets 25 and 26 are preferably constructed of plastics material but are provided with a metallic plating, such as a chrome nickel plating, therearound. Alternately, the brackets 25 and 26 could in their entirety be constructed of metal, such as aluminum. Due to the provision of one diametrically opposite pair of conductive brackets and one diametrically opposite pair of nonconductive brackets, the rear cross rail 17 and the right side rail 14 hence define one elongated path or arm of a television antenna, and the front cross rail 16 and the left side rail 15 hence define another elongated arm or path for the TV antenna. These two arms or paths are each of substantial length, are each of substantially equally length, and are electrically isolated from one another in nonconductive relationship to permit their efficient performance as receivers for television signals.

To complete the antenna part of the rack, a conventional television transformer 45, such as a Balun transformer, is connected to the rectangular frame 13 adjacent one of the corners having the insulative bracket 24 or 27 associated therewith. This transformer is preferably connected adjacent the rear corner on the driver's side, as illustrated by the drawings, which corner has the insulative bracket 27 associated therewith.

The transformer 45 has a pair of conductive leads 46 and 47 extending therefrom, with one lead 46 being secured to the adjacent end of the left side rail 15 in conductive relationship therewith, such as by a securing screw 48. In similar fashion, the other lead 47 is fixedly secured in conductive relationship with the adjacent end of the rear cross rail 17, as by a screw 49. These leads 46 and 47 hence secure to the respective rails 15 and 17 closely adjacent but on opposite sides of the insulative bracket 27 to thus maximize the length of the two arms or antenna paths defined by the rails 15, 16 and 14, 17, respectively. The conductors 46 and 47 are each preferably formed from thin platelike members having substantial length, which platelike members are effectively formed as rather stiff spring-like elements so as to provide substantial support for the transformer while still permitting the leads to accommodate the motions and impact forces imposed on the transformer due to movement of the vehicle.

As is conventional, the transformer has a standard socket 51 which accommodates therein a conventional jack (not shown) provided on one end of an elongated coaxial cable, which cable in turn is fed through a small sealed boot provided in the roof of the vehicle in close proximity to the transformer for enabling the cable to be fed into the interior of the vehicle for connection to the television set.

As illustrated by FIG. 1, the rack of the present invention is preferably utilized in conjunction with luggage support strips 51 which are secured to the vehicle roof within the pocket defined by the rack frame. Each of these strips 51 is elongated and preferably has a plastic element on the upper side thereof and extending longitudinally thereof for providing a support for the luggage. These strips 51 are conventionally secured directly to the vehicle roof by adhesive strips, and by additional use of screws if desired. These strips, however, have no direct connection to the rack.

Use of the antenna luggage rack 12 of this invention, both as a luggage rack and as a TV antenna, is believed self-evident from the description set forth above so that further detailed description thereof is believed unnecessary.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An antenna roof rack for a vehicle, comprising:

a rigid, rectangular, ringlike frame defined by right and left substantially parallel side rails rigidly joined together by front and rear cross rails which extend perpendicularly therebetween, said rails all being of metal;

stanchion means fixedly secured to said frame adjacent each of the four corners thereof and projecting downwardly therefrom for fixed attachment to the roof of a vehicle, said stanchion means maintaining said frame in upwardly spaced relationship from the vehicle roof, said stanchion means having insulator means associated therewith for insulating said frame from said roof;

said frame including bracket means at each of the corners thereof for providing a fixed connection between each side rail and the adjacent end of the respective cross rail, said bracket means at a first diametrically opposed pair of corners of said frame being of an electrically nonconductive material to effectively insulate the side and cross rails from one another at these corners, and said bracket means at the other pair of diametrically opposed corners of said frame being of an electrically conductive material to create an electrically conductive path between the connected side and cross rails at these latter corners; and television transformer means connected to said frame adjacent one of the corners having said nonconductive bracket means associated therewith, said transformer means having a first conductive lead which is electrically connected to the respective side rail at said one corner in close proximity to the nonconductive bracket means, said transformer means having a second conductive lead which is electrically connected to the respective cross rail at said one corner in close proximity to said nonconductive bracket means;

the side rail which connects to said one corner and the remaining cross rail defining a first long conductive path, and the cross rail which connects to said one corner and the remaining side rail defining a second long conductive path, said first and second paths being of substantially the same length.

2. An antenna luggage rack according to claim 1, wherein said first and second conductive elements each comprise thin platelike spring strips of substantial width.

3. An antenna luggage rack according to claim 1, wherein the nonconductive bracket means are of a plastics material, and wherein the conductive bracket means have a core of a plastics material provided with a metal plating thereon.

4. An antenna luggage rack according to claim 3, wherein the conductive bracket means are identical to the nonconductive bracket means except for the provision of the metal plating on the conductive bracket means.

* * * * *